US008594349B2

(12) United States Patent
Chen et al.

(10) Patent No.: US 8,594,349 B2
(45) Date of Patent: Nov. 26, 2013

(54) FLAT SPEAKER STRUCTURE

(75) Inventors: Ming-Daw Chen, Hsinchu (TW); Chang-Ho Liou, Changhua County (TW); Kuo-Hua Tseng, Taipei County (TW); Kuan-Wei Chen, Taichung County (TW)

(73) Assignee: Industrial Technology Research Institute, Hsinchu (TW)

( * ) Notice: Subject to any disclaimer, the term of this patent is extended or adjusted under 35 U.S.C. 154(b) by 1002 days.

(21) Appl. No.: 12/649,330

(22) Filed: Dec. 30, 2009

(65) Prior Publication Data

US 2010/0260370 A1 Oct. 14, 2010

(30) Foreign Application Priority Data

Apr. 9, 2009 (TW) ..... 98111841 A

(51) Int. Cl.
*H04R 25/00* (2006.01)

(52) U.S. Cl.
USPC ..... 381/191; 381/150; 381/174

(58) Field of Classification Search
USPC ..... 381/174, 191, 150
See application file for complete search history.

(56) References Cited

U.S. PATENT DOCUMENTS

| | | | | |
|---|---|---|---|---|
| 3,894,199 | A | 7/1975 | Tamura et al. | |
| 2009/0067648 | A1 * | 3/2009 | Liou et al. | 381/191 |
| 2009/0214049 | A1 * | 8/2009 | Lee et al. | 381/71.1 |
| 2010/0215197 | A1 * | 8/2010 | Lee et al. | 381/191 |

FOREIGN PATENT DOCUMENTS

| | | |
|---|---|---|
| TW | 440446 | 6/2001 |
| TW | 200913753 | 3/2009 |
| TW | 200913757 | 3/2009 |

OTHER PUBLICATIONS

"Office Action of Taiwan Counterpart Application", issued on Dec. 17, 2012, p. 1-p. 7, in which the listed reference was cited.
"First Office Action of China Counterpart Application", issued on Jun. 25, 2012, p. 1-p. 5, in which the listed references were cited.

* cited by examiner

*Primary Examiner* — Duc Nguyen
*Assistant Examiner* — Matthew Eason
(74) *Attorney, Agent, or Firm* — Jianq Chyun IP Office

(57) ABSTRACT

A speaker structure includes a membrane, an electrode which has a plurality of holes, a frame holding member and at least one set of supporting members. The frame holding member forms an exterior shape of the speaker structure and holds the membrane and the electrode at two opposite sides. Each of the set of the supporting members has a geometric structure and is placed in a space opposite to a soniferous hole region between the electrode and the membrane, so as to prevent the membrane and the electrode from contacting.

23 Claims, 8 Drawing Sheets

FLAT SPEAKER STRUCTURE

CROSS-REFERENCE TO RELATED APPLICATION

This application claims the priority benefit of Taiwan patent application serial no. 98111841, filed on Apr. 9, 2009. This application is also related to patent application Ser. No. 12/175,467, filed on Jul. 18, 2008, entitled "STRUCTURE AND MANUFACTURING METHOD OF ELECTROSTATIC SPEAKER", now pending. This application is also related to patent application Ser. No. 12/370,598, filed on Feb. 13, 2009, entitled "SPEAKER DEVICES", now pending. The entire disclosures, including the claims, of aforesaid applications are hereby incorporated by reference herein and made a part of this specification.

BACKGROUND

1. Technical Field

The disclosure relates to a structure of a flat speaker.

2. Background Art

The two most direct sensory systems of human being are visual and audible systems, so for a long time, scientists have given great effort to developing related elements or system techniques. Currently, electro-acoustic speakers are mainly classified into direct and indirect radiating types, and are approximately classified into dynamic, piezoelectric, and electrostatic speakers according to driving methods.

Electrostatic speakers mainly include hi-end earphones and loudspeakers in the current market. The operating principle for conventional electrostatic speakers is that two electrodes which are fixated and have holes are used to clamp a conductive membrane to form a capacitor, a DC bias is applied to the membrane and an AC voltage of sound frequencies is applied to the two fixated electrodes, and electrostatic forces generated by positive and negative electric fields are used to drive the conductive membrane to vibrate and to radiate sounds. The bias of the conventional electrostatic speakers is as high as hundreds to thousands of volts, so that expensive and bulky amplifiers need to be externally connected. Hence, the above is the reason that the conventional electrostatic speakers are not popular. If the electrostatic speakers cooperate with structural designs of membranes that are ferroelectric, although the AC voltage of the sound frequencies is lowered, the electrostatic effects of the membrane causes the electrode and the membrane to contact each other and thereby inhibiting sound production.

Relating to electrostatic speakers, U.S. Pat. No. 3,894,199 discloses an electro-acoustic transducer, as shown in FIG. 1, which is a schematic view showing an electro-acoustic converter according to U.S. Pat. No. 3,894,199. A frame holding member 110 made of an insulating material holds two fixated electrodes 120. A membrane 130 is disposed between the two electrodes 120. A plurality of holes 121 are disposed in the electrodes 120 to allow sounds to radiate through. A polarization voltage 141 passes through the membrane 130, each of the electrodes 120, a step-up transformer 140 and an resistor 142. A primary winding 143 of the step-up transformer 140 is connected to a signal source 150. Voltages of the two electrodes 120 are supplied by an AC signal of the signal source 150. The voltages of the two electrodes 120 are opposite, meaning that one is positive and the other is negative.

As illustrated in the related art, the frame holding member 110 is only used to hold the electrodes 120, and there are no supporting members between the membrane 130 and the electrodes 120, so that unintended contact between the electrodes 120 and the membrane 130 cannot be prevented. It can be known that present flat speakers do not provide design descriptions relevant to supporting members.

In addition, the conventional electrostatic speaker have weaker capacity for generating sounds of lower frequencies (<500 Hz), so that the electrostatic speakers on the market are mostly collocated with a dynamic speaker having low frequency response. Hence, it is known that improving low sound pressures at low frequencies of the conventional electrostatic speakers is an important issue in the field.

SUMMARY

The embodiment provides a flat speaker structure. According to an embodiment, the speaker structure provided by the embodiment includes a membrane, an electrode, a frame holding member and at least one set of supporting members. The electrode has a plurality of holes, and the frame holding member forms an exterior shape of the speaker structure and holds the membrane and the electrode at two opposite sides. Each of the sets of the supporting members is disposed between non-porous areas of the electrode and the membrane and forms at least one ring-shaped geometric structure

BRIEF DESCRIPTION OF THE DRAWINGS

The accompanying drawings are included to provide a further understanding of the embodiment, and are incorporated in and constitute a part of this specification. The drawings illustrate embodiments and, together with the description, serve to explain the principles of the embodiment.

DESCRIPTION OF EMBODIMENTS

Figure 1:
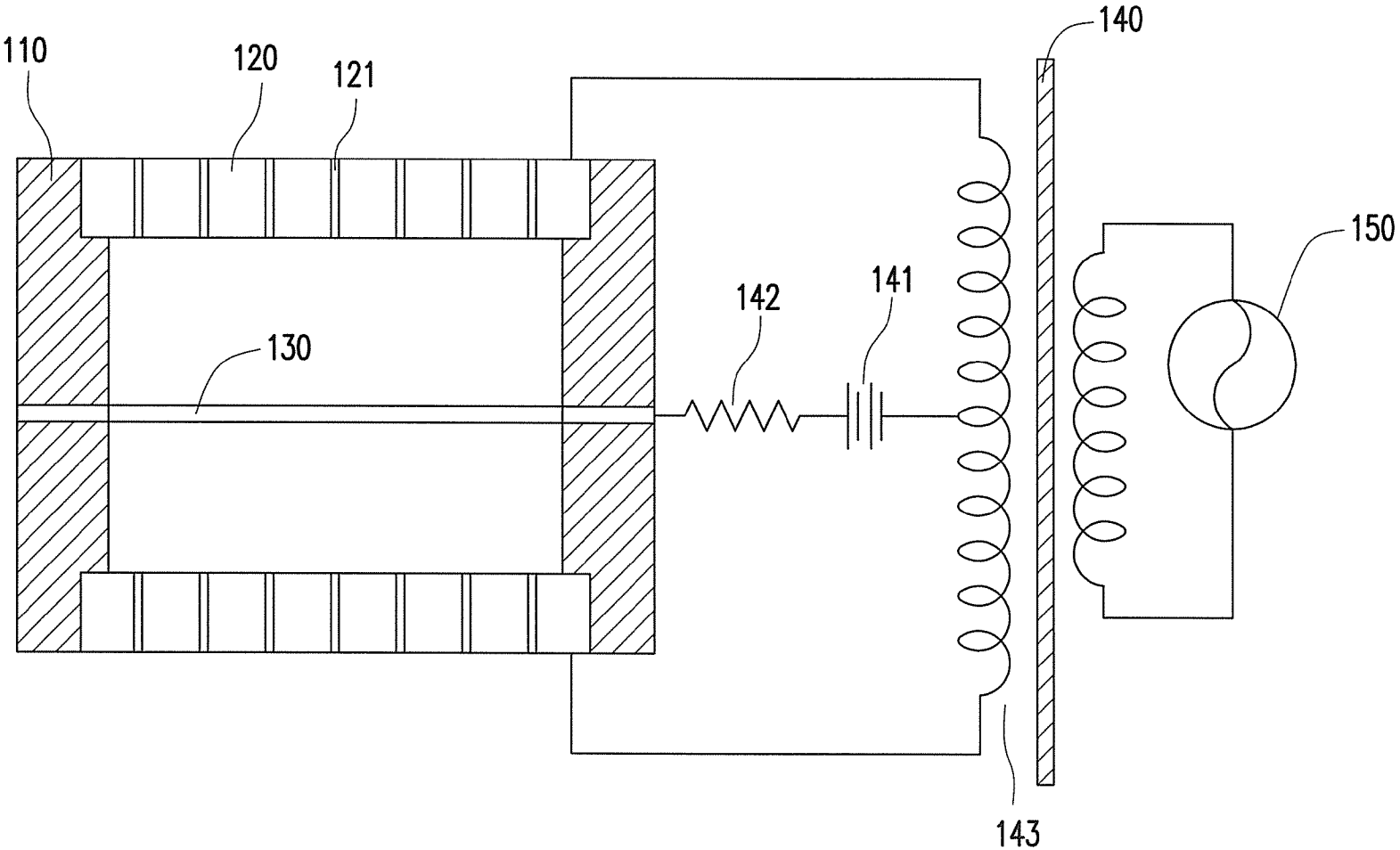
FIG. 1 (RELATED ART)
FIG. 1 is a schematic view showing an electro-acoustic converter according to U.S. Pat. No. 3,894,199.

An embodiment may provide flat electrostatic speakers or speaker chamber structures that may be light, thin and/or flexible. Such embodiments may suit the current demand for flat or thin electrostatic speakers and may occupy less space or provide flexibility in the speaker structures themselves.

In some embodiments, a flat electrostatic speaker structure may include a frame, a diaphragm or membrane, an electrode above the membrane, a set of supporting members installed in a chamber space formed in the speaker structure. The chamber is enclosed between the electrode and the membrane. The supporting members are provided in the chamber space, which may be called a sound-chamber.

The electrode has a plurality of holes as soniferous holes for the sound generated by the speaker. The frame forms an exterior shape of the speaker structure and holds the membrane and the electrode at two opposite sides. Each of the sets of the supporting members is disposed between non-porous areas of the electrode and the membrane and forms at least one geometric structure.

An embodiment provides designs of the geometric structure for the supporting members to prevent the electrode from contacting the membrane due to electrostatic force, since the improper contact of the electrode and the membrane may inhibit sound production from the flat speaker. The designs can also simultaneously improve sound pressures when the flat speaker operates at low frequencies.

In some embodiments, the geometric structure for the supporting members of a flat electrostatic speaker can be fabricated by being integrated into the existing processes of making flat electrostatic speakers and therefore may be suitable for mass production.

Some embodiments of the structures of the flat electrostatic speakers, the electrode, and the membrane can be found in co-pending patent application Ser. No. 12/175,467, filed on Jul. 18, 2008, entitled "STRUCTURE AND MANUFACTURING METHOD OF ELECTROSTATIC SPEAKER" and patent application Ser. No. 12/370,598, filed on Feb. 13, 2009, entitled "SPEAKER DEVICES", which are hereby incorporated by reference herewith and made a part of this specification.

The electrode can be made of metal material or other conductive materials. The membrane may include an electret layer and a conductive electrode, in which the electret layer is made of, for example, electret materials. The conductive material can be metal (e.g., iron, copper, aluminum or an alloy thereof), conductive cloths (e.g., metal fiber, oxide metal fiber, carbon fiber or graphite fiber), etc., or any combination of these materials or other materials. To provide good tension and/or vibration effects of the membrane, the conductive electrode can be a metal film electrode such as a thin metal film electrode. As an example, its thickness may be between 0.2 micron and 0.8 micron. It may be about 0.3 micron in some embodiments. The scale range illustrated is usually identified as "ultra-thin." Considering that the ultra-thin metal thin film electrode may be used when being exposed in the air and would be oxidized into a complete nonconductor, thereby affecting input of an audio signal, an insulating layer may be produced on a surface of the metal thin film electrode, but a position for an input end of the audio signal must be preserved.

When the conductive electrode is made of a nonconductive material layer plated with a metal film layer, the nonconductive material can be plastic, rubber, paper, a nonconductive cloth (cotton fiber or polymer fiber) or other nonconductive materials; and the metal film can be aluminum, gold, silver, copper, Ni/Au bimetal, indium tin oxide (ITO), indium zinc oxide (IZO), macromolecule conductive material PEDOT (polyethylenedioxythiophene), an alloy, any combination of the listed materials or equivalents thereof.

The designs of the supporting members of the speaker of the embodiment are a considerable issue for the flat speaker. The supporting members are disposed between the electrode and the membrane, so as to prevent the membrane having electrostatic effects from being improperly contacted by the electrode, which may cause the flat electrostatic speaker to fail in generating sounds. The specific designs of the supporting members can also improve the sound pressures when the flat electrostatic speaker operates at low frequencies.

The supporting members disposed between the electrode and the membrane form at least one geometric structure, in which a working area of the speaker is enclosed by the geometric structure of the supporting members. In some embodiments, the supporting members may be designed into different arrangements according to intensities of electrostatic effects of the membrane. For example, the geometric structure of the supporting member may be designed as a shape of a circle, oval, hexagon, square, rhombus, rectangle, triangle or any combination of the above. The geometric structures may be substantially concentric, meaning that the centers of the geometric structures may substantially overlap. Alternatively, the geometric structures may be disposed non-concentrically. For explanation, a supporting member with a ring-shaped geometric structure is introduced hereinafter, but some other shapes in different embodiments can be used and the embodiment is not limit thereto.

In some embodiments, the supporting members may have different patterns in placing the members or heights, which can be varied based on different applications or specifications. The ring-shaped geometric structures may be arranged by adjusting distances between the supporting members or heights of the supporting members. For example, the distances between the ring-shaped geometric structures may be equal or unequal, and the heights of the supporting members may be uniform or non-uniform. In addition, the ring-shaped geometric structures may be a closed figure structure formed by a continuous line or an open figure structure formed by broken lines, as shown. Differences of the distances between the supporting members or the heights of the supporting members are considerable issues in designing the overall frequency response of the speaker structure. For example, the different distances or heights are adjusted according to the optimal frequency range for using the speaker.

The supporting members provided by the embodiment may be directly produced on the electrode or directly produced on the membrane. In some embodiments, the supporting members may adhere to or not adhere to the membrane or the electrode, or the supporting members may be produced in advance and then inserted between the electrode and the membrane after completion.

In some embodiments, the supporting members may be fabricated on a substrate using transfer printing, direct printing such as inkjet printing or screen plane printing. In another embodiment, the supporting members may be fabricated by direct adhesion. As an example, the supporting members may be fabricated in advance, followed by placing the pre-fabricated supporting members between a metal electrode with holes and the membrane. The supporting members may be placed on the membrane or the electrode with holes with direct adhesion or without direct adhesion to the underlying membrane or electrode. In other embodiments, the supporting members can be fabricated using etching, photolithography, and/or adhesive-dispensing techniques.

The flat electrostatic speaker uses the principle of properties of charges in the material of the membrane and effects of electrostatic forces. When the membrane is stimulated by external voltages, a surface of the membrane is deformed, thereby driving the air near the membrane to produce sound. As known from the electrostatic force equation and energy laws, the force exerted on the membrane equals the capacitance value of the where speaker multiplied by the intensity of the internal electric field and the externally-input sound voltage signal. When the force exerted on the membrane is larger, the output sound generated accordingly is louder. According to Coulomb's law, the product of the electric charges of two charged objects is in direct proportion to the electrostatic forces exerted on each other and is in inverse proportion to the square of the distance between the two objects. If the charges of the objects are both positive or negative, the objects would repel each other, if the charges on one of the objects are positive and the charges on the other of the objects are negative, the objects would attract each other. The equation for electrostatic forces may be represented by Equation 1.

$$P = \frac{2V_{in}V_e\varepsilon_0\left(\frac{1}{S_a} + \frac{\varepsilon_e}{S_e}\right)\varepsilon_e S_e}{(S_e + \varepsilon_e S_a)^2} \quad \text{(Equation 1)}$$

A capacitance ratio $\in_o$ equals $8.85\times10^{-12}$ F/m, $\in_e$ is a dielectric constant of an electret, $S_e$ is a thickness of the electret, $S_a$ is a thickness of an air layer, $V_{in}$ is a voltage of an input signal, $V_e$ is a voltage of the electret and P is a force per unit area of the membrane. Hence, at the same distance, if the electrostatic speakers contain large numbers of charges, audio voltage signals input into the speakers may be lowered to several volts to tens of volts, so that practicality of the flat electrostatic speaker is enhanced.

Hence, the embodiment provides an implementation method as the following. A material of the electrode having the holes may be metal or a conductive material. The holes in the metal material are advantageous to the spreading of sound. According to another embodiment, the same effect may be achieved by electroplating a conductive electrode layer on an extremely thin paper.

According to an embodiment, the membrane includes the electret material such as a dielectric material. The dielectric material maintains static charges for a long time after being electrized, generates ferroelectric effects in the material after being charged, and is thus called the electret membrane. The electret membrane may be a membrane which includes a single layer or multiple layers of dielectric material. The above dielectric material may be, for example, fluorinated ethylene propylene (FEP), poly tetra fluoro ethyene (PTFE), polyvinylidene fluoride (PVDF), fluorine polymers and other suitable materials. The electret membrane is a membrane capable of maintaining the static charges and piezoelectricity for a long time after the dielectric material is electrized, and includes micro nano-holes to increase transparency of light and piezoelectric characteristics. Thus, after being charged by corona, dipolar charges are generated in the material to generate the ferroelectric effect.

A transparent and flexible material, for example a plastic material, may be adopted as the material of the supporting members, so as to increase diversity of designs for using the supporting members.

According to the supporting members of the speaker, the following illustrates using an embodiment.

Figure 2A:
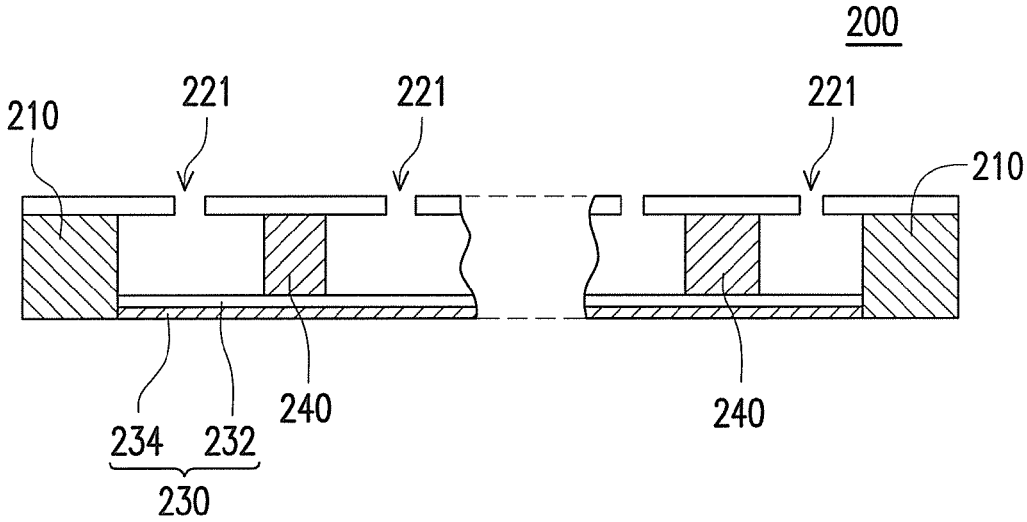
FIGS. 2A and 2B are sectional schematic views showing a speaker structure according to an embodiment.
Figure 2B:
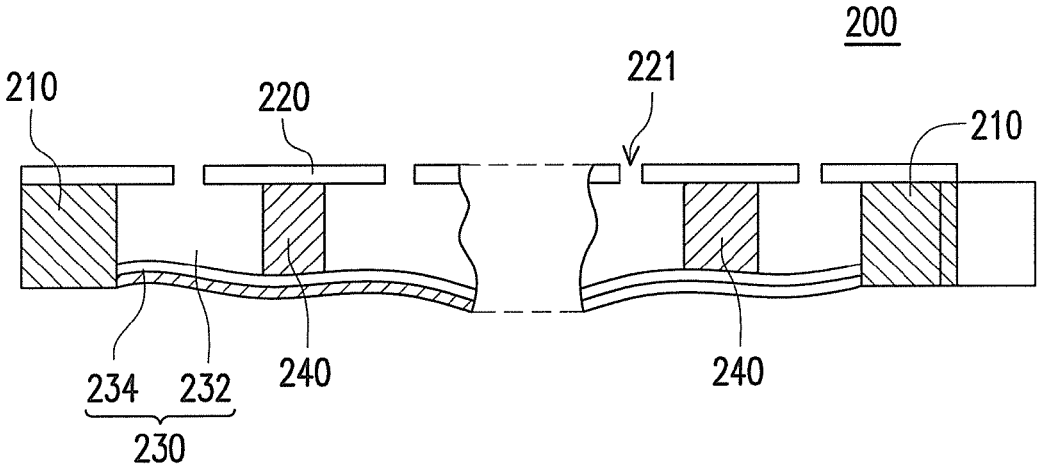

Please refer to FIGS. 2A and 2B, which are sectional schematic views showing a speaker structure according to an embodiment. A speaker structure 200 includes a frame holding member 210 which forms an exterior shape of the speaker structure, an electrode 220 having a plurality of holes 221, a membrane 230 and at least one set of supporting members 240 disposed in between. The electrode 220 having the holes and the membrane 230 are respectively fixated at the frame holding member 210, are opposite to each other and are supported by the frame holding member 210 connected to two sides thereof so as to not contact each other. A height of the frame holding member 210 may be equal to heights of the supporting members 240 or may be higher and may be determined according to requirements of the design of the speaker structure. The membrane 230 includes an electret layer 232 and a conductive electrode layer 234.

In order to the prevent the electrostatic effect generated by the membrane 230 from causing the membrane 230 and the electrode 220 to contact each other, at least one set of supporting member 240 may be placed in a space opposite to a soniferous hole region. In various embodiments, the supporting members 240 may be produced on the electrode 220 or on the membrane 230. In some embodiments, the supporting members 240 may adhere to or not adhere to the membrane 230 or the electrode 220. Alternatively, the supporting members 240 may be produced first and then placed in the space between the electrode 220 and the membrane 230.

The supporting members 240 are disposed while taking into consideration the number of charges and the intensity of the electrostatic effect, so as to adopt an optimal disposition. In addition, different disposition distances of the supporting members are taken into consideration to adopt designs of the supporting members having different heights. Objectives of the above designs are to exclude possibilities of contact between the electrode 220 and the membrane 230 except for the supporting members 240, as shown in FIG. 2B.

Using the supporting members according to the above embodiment, the supporting members 240 may be produced on the electrode 220 or the membrane 230 by using transferring or decaling. According to another embodiment, the supporting members 240 may be produced using printing technologies including direct printing, screen plane printing or lamination. The above supporting members 240 may also be formed using a photoresist or etching.

Figure 3A:
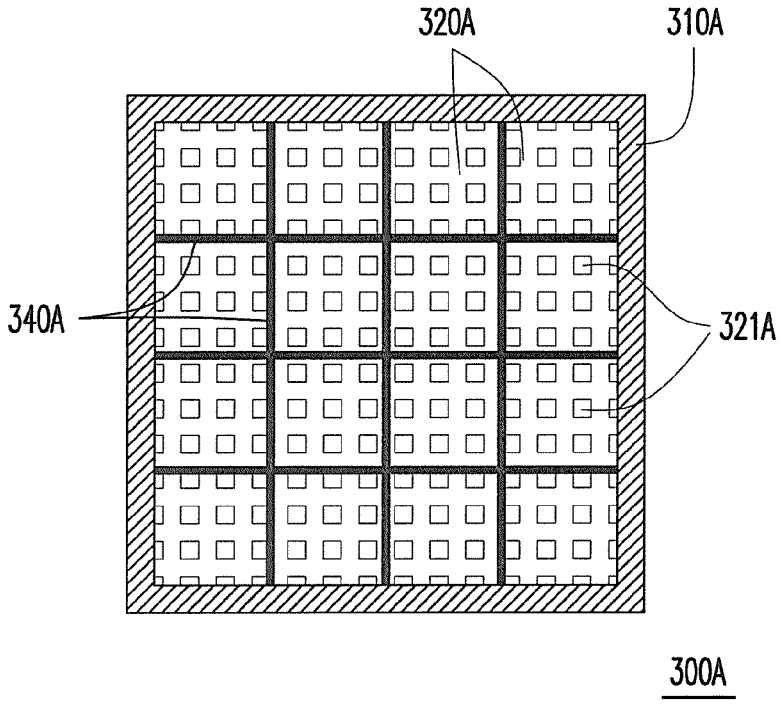
FIG. 3A is a top perspective schematic view showing a speaker structure according to an embodiment.

Please refer to FIG. 3A, which is a top perspective schematic view showing a speaker structure according to an embodiment. A speaker structure 300A includes a frame holding member 310A which forms an exterior shape of the speaker structure, an electrode 320A and a membrane (not shown). For convenience of illustration, the speaker structure 300A is square as an example, but is not limited to being square. Designs of the speaker structures having any shape are suitable for the embodiment. According to the embodiment, the electrode 320A includes a plurality of holes 321A, and at least one set of supporting members 340A may be placed in a space opposite to a soniferous hole region. By using the supporting members 340A, the electrode 320A and the membrane are prevented from contacting to each other due to electrostatic forces and are also prevented from causing inhibition of sound production.

Figure 3B:
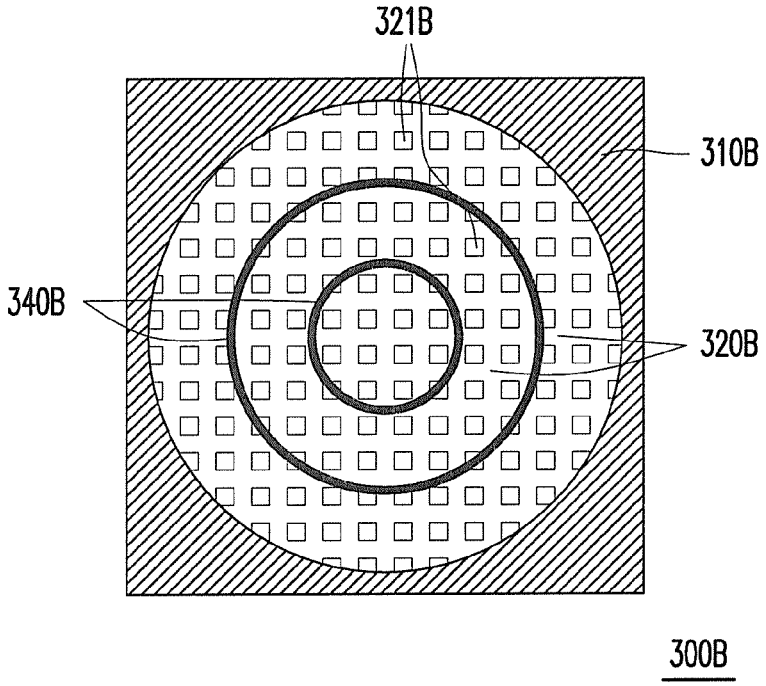
FIG. 3B is a top perspective schematic view showing a speaker structure according to an embodiment.

Please refer to FIG. 3B, which is a top perspective schematic view showing a speaker structure according to an embodiment. A speaker structure 300B includes a frame holding member 310B which forms an exterior shape of the speaker structure, an electrode 320B and a membrane (not shown). For convenience of illustration, the speaker structure 300B is circular as an example, but is not limited to being circular. Designs of the speaker structures having any shapes are suitable for the embodiment. In the speaker structure, the electrode 320B has a plurality of holes 321B. At least one set of supporting members 340B are may be placed in a space opposite to a soniferous hole region between the electrode 320B and the membrane. The supporting members 340B are circle in shapes, and the circles may be substantially concentric, meaning that centers of the circles substantially overlap. Alternatively, the circles may be disposed non-concentrically. By using the supporting members 340B, the electrode 320B and the membrane are prevented from contacting to each other due to electrostatic forces and are also prevented from causing inhibition of sound production.

Figure 4A:
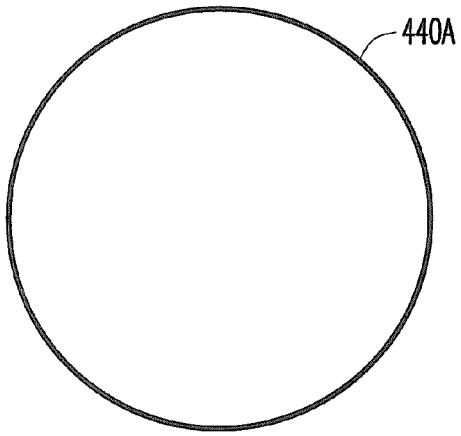
FIG. 4A is a schematic view showing a supporting member of a speaker structure according to an embodiment.
Figure 4B:
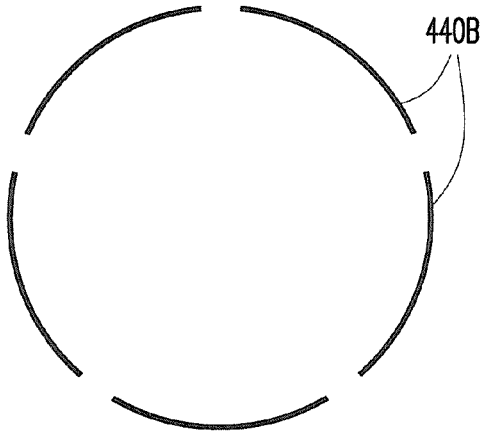
FIG. 4B is a schematic view showing a supporting member of a speaker structure according to an embodiment.

Next, please refer to FIG. 4A, which is a schematic view showing a supporting member of a speaker structure according to an embodiment. According to the embodiment, a supporting member 440A of the speaker structure is a ring-shaped geometric structure. The supporting member 440A can be a circular structure, and the circular structure is closed and formed by a continuous line. Alternatively, please refer to FIG. 4B, which is a schematic view showing a supporting member of a speaker structure according to an embodiment. The supporting member 440B is a circular structure, and the circular structure is open and formed by broken lines, thereby forming a substantially ring-shaped geometric structure.

Figure 4C:
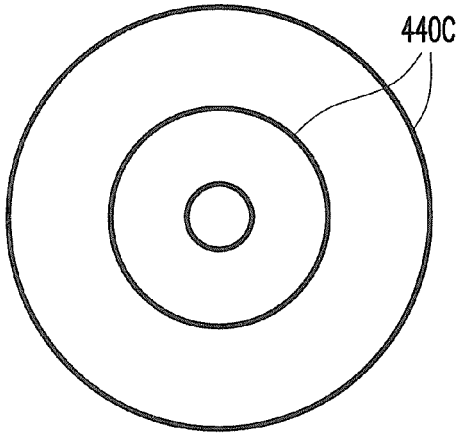
FIG. 4C is a schematic view showing supporting members of a speaker structure according to an embodiment.
Figure 4D:
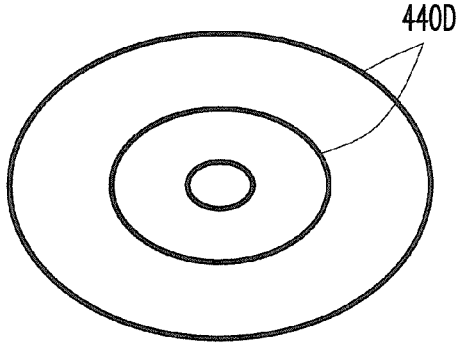
FIG. 4D is a schematic view showing supporting members of a speaker structure according to an embodiment.
Figure 4E:
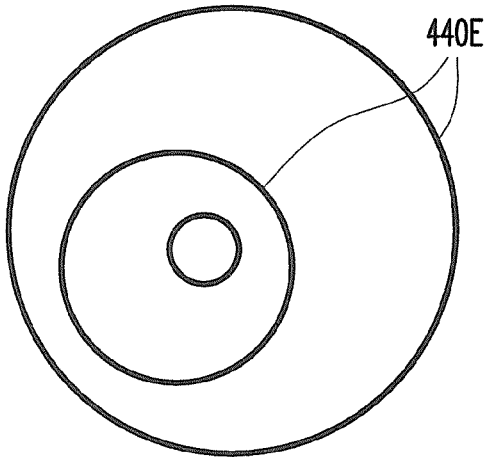
FIG. 4E is a schematic view showing supporting members of a speaker structure according to an embodiment.
Figure 4F:
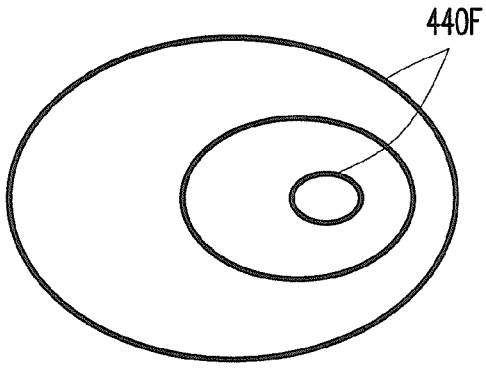
FIG. 4F is a schematic view showing supporting members of a speaker structure according to an embodiment.
Figure 4G:
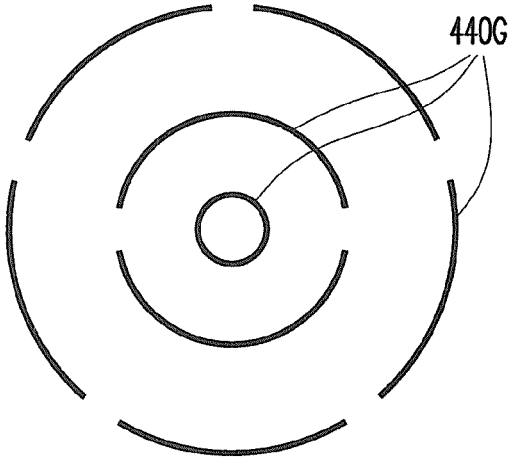
FIG. 4G is a schematic view showing supporting members of a speaker structure according to an embodiment.

Please refer to FIG. 4C, which is a schematic view showing supporting members of a speaker structure according to an embodiment. The supporting members of the speaker structure form at least one set of ring-shaped geometric structures. The ring-shaped geometric structures may be substantially concentric, meaning that the centers of the ring-shaped geometric structures may substantially overlap. Alternatively, the ring-shaped geometric structures may be disposed non-concentrically, such as the non-concentric ring-shaped geometric structures formed by supporting members 440E in FIG. 4E. According to the embodiment, supporting members 440C form at least one circular structure, and the circular structures are closed and formed by a continuous line. Alternatively, please refer to FIG. 4D, which is a schematic view showing supporting members of a speaker structure according to an embodiment. Each of the supporting members 440D is an oval structure. The oval structures may be substantially concentric, meaning that the centers of the oval structures may substantially overlap. Alternatively, the oval structures may be disposed non-concentrically, such as the non-concentric oval structures formed by supporting members 440F in FIG. 4F. In addition, please refer to FIG. 4G, which is a schematic view showing supporting members of a speaker structure according to an embodiment. According to the embodiment, each of the supporting members 440G is a circular structure, and each of the circular structures is a closed figure structure formed by a continuous line or an open figure structure formed by broken lines. The circular structures may be substantially concentric, meaning that the centers of the circular structures may substantially overlap Please note that according to the embodiment, the ring-shaped geometric structures may be disposed non-concentrically. In other words, each of the non-concentric ring-shaped geometric structures formed by supporting members 440E and 440F in FIGS. 4E and 4F respectively may be a closed figure structure formed by a continuous line or an open figure structure formed by broken lines.

Figure 4H:
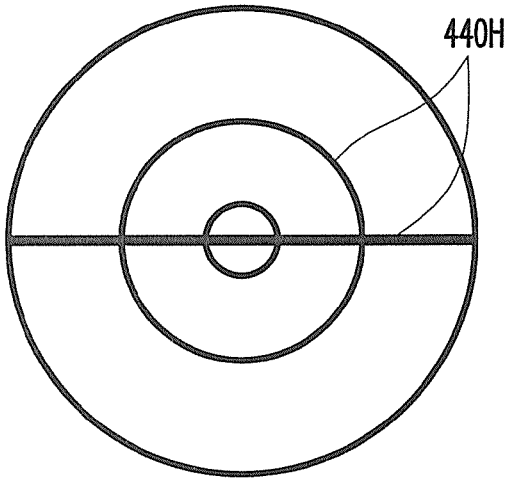
FIG. 4H is a schematic view showing supporting members of a speaker structure according to an embodiment.
Figure 4I:
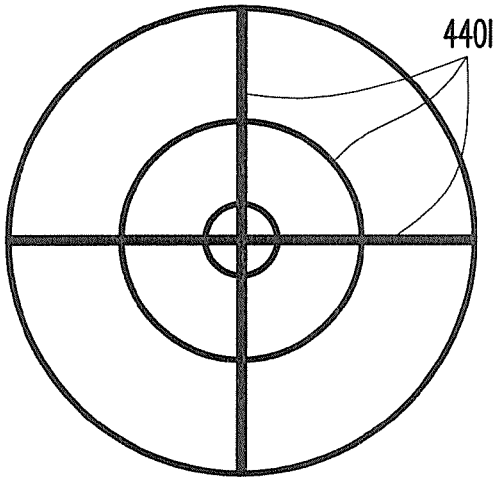
FIG. 4I is a schematic view showing supporting members of a speaker structure according to an embodiment.

Alternatively, besides forming at least a set of ring-shaped geometric structures, the supporting members may additionally form a line-shaped or cross-shaped structure, as shown in FIGS. 4H and 4I, which are schematic views of each showing the supporting members of a speaker structure according to an embodiment. Referring to FIGS. 4H and 4I, supporting members 440H and 440I form at least a set of ring-shaped geometric structures and an additional line-shaped or cross-shaped structure.

The above embodiments are only used for illustration and not for limiting the embodiment. The ring-shaped geometric structure formed by the supporting members may be hexagonal structures, square structures, rhombus structures, rectangular structures, triangular structures, polygon structures, any combination of the above or any geometric structures.

In order to enhance effects of frequency response of the speaker, the distances between the ring-shaped geometric structures formed by the supporting members may be arbitrarily adjusted, so as to obtain the best sound producing effects. The distances between the ring-shaped geometric structures may be equal or unequal. The heights of the supporting members may also be arbitrarily adjusted to achieve the best sound producing effects. The heights of the supporting members may be uniform or non-uniform. In addition, the ring-shaped geometric structures may be a closed figure structure formed by a continuous line or an open figure structure formed by broken lines.

Figure 5A:
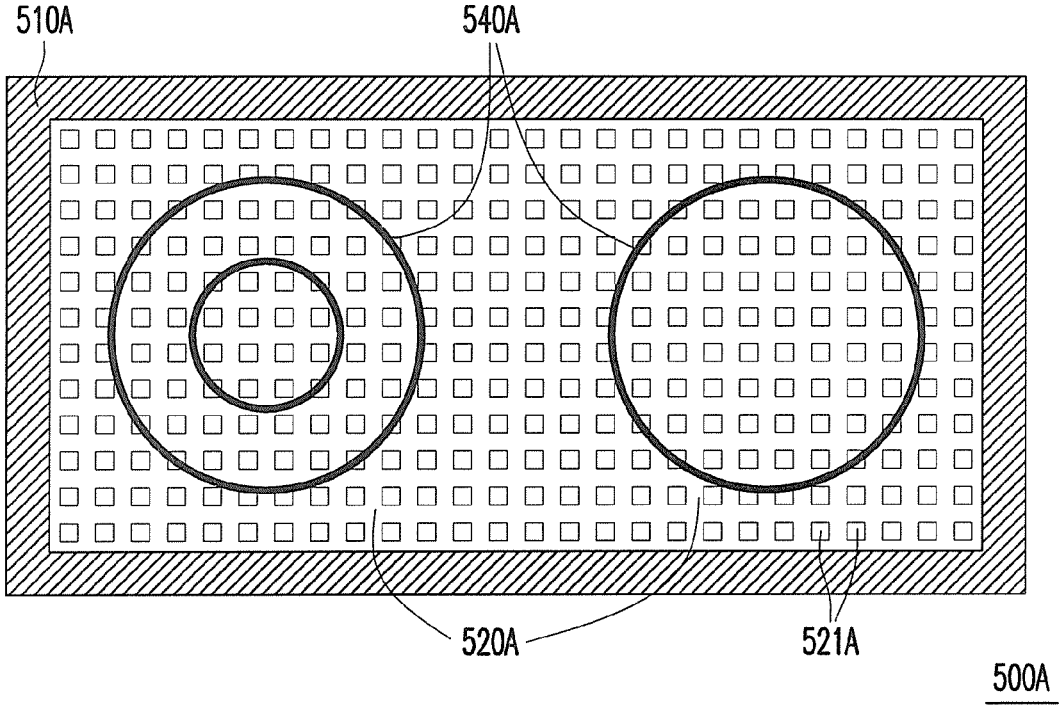
FIG. 5A is a top perspective schematic view showing a speaker structure according to an embodiment.

Please refer to FIG. 5A, which is a top perspective schematic view showing a speaker structure according to an embodiment. A speaker structure 500A includes a frame holding member 510A which forms an exterior shape of the speaker structure, an electrode 520A and a membrane (not shown). According to the embodiment, the electrode 520A has a plurality of holes 521A. At least one set of supporting members 540A may be placed in a space opposite to a soniferous hole region between the electrode 520A and the membrane, wherein each of the sets of supporting members forms at least one ring-shaped geometric structure. The ring-shaped geometric structures may be substantially concentric, meaning that the centers of the ring-shaped geometric structures may substantially overlap. Alternatively, the ring-shaped geometric structures may be disposed non-concentrically. By using the supporting members 540A, the electrode 520A and the membrane are prevented from contacting to each other due to electrostatic forces, are also prevented from causing inhibition of sound production.

Figure 5B:
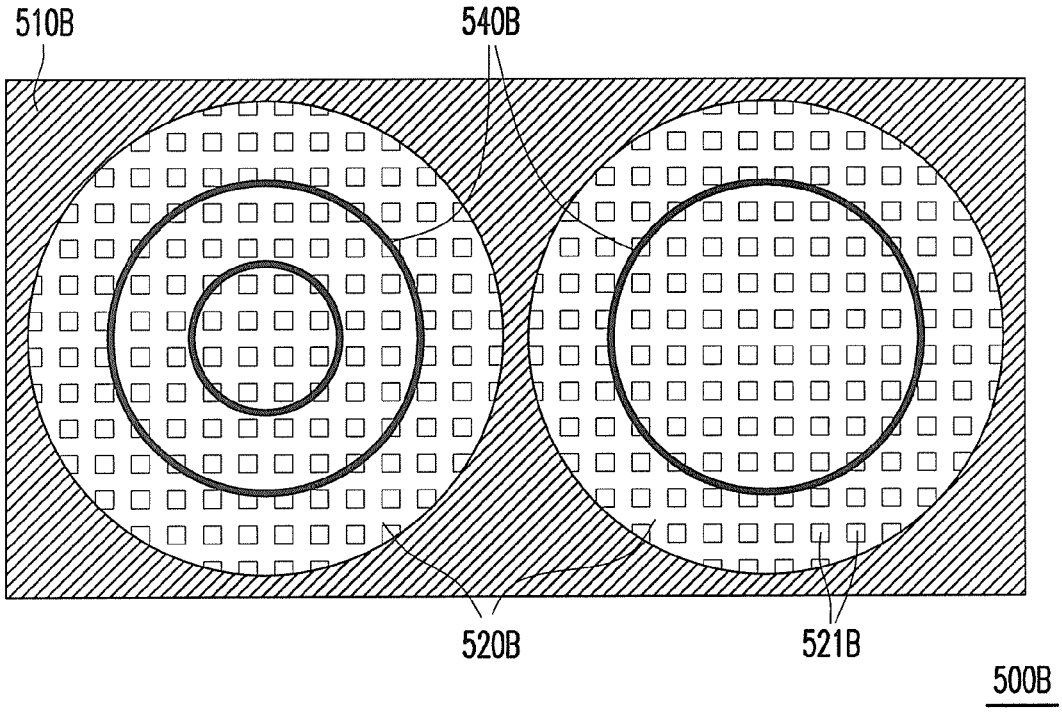
FIG. 5B is a top perspective schematic view showing a speaker structure according to an embodiment.

Please refer to FIG. 5B, which is a top perspective schematic view showing a speaker structure according to an embodiment. A speaker structure 500B includes a frame holding member 510B which forms an exterior shape of the speaker structure, an electrode 520B and a membrane (not shown). According to the embodiment, the electrode 520B has a plurality of holes 521B. At least one set of supporting members 540B are may be placed in a space opposite to a soniferous hole region between the electrode and the membrane, wherein each of the sets of supporting members forms at least one ring-shaped geometric structure. The ring-shaped geometric structures may be substantially concentric, meaning that the centers of the ring-shaped geometric structures may substantially overlap. Alternatively, the ring-shaped geometric structures may be disposed non-concentrically. By using the supporting members 540B, the electrode 520B and the membrane are prevented from contacting to each other due to electrostatic forces and are also prevented from causing inhibition of sound production.

Figure 6A:
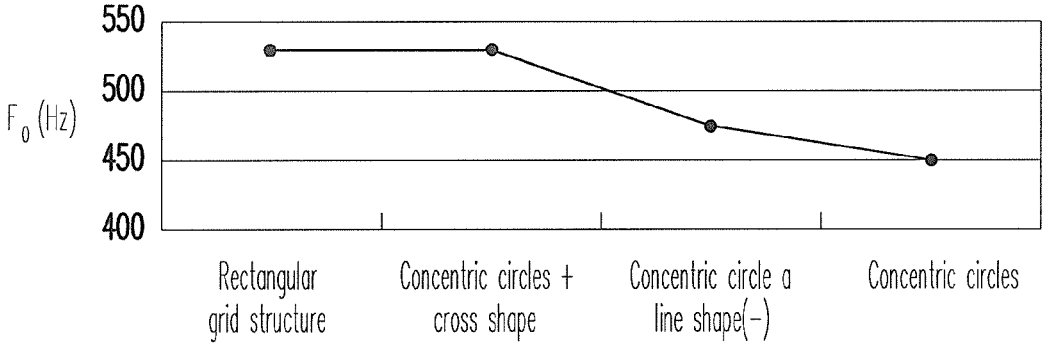
FIG. 6A is a line chart showing a first natural frequency ($F_0$) of speaker structures having supporting members which are arranged differently.

Next, please refer to FIG. 6A, which is a line chart showing a first natural frequency ($F_0$) of speaker structures having supporting members arranged in different patterns. When supporting members with a square shape form a rectangular grid figure structure, a first nature frequency thereof is 525 Hz; when supporting members with a circular shape form two concentric circular structures and a cross-shaped structure, a first nature frequency thereof is 525 Hz; when supporting members with a circular shape form two concentric circular structures and a line-shaped structure, a first nature frequency thereof is 475 Hz; when supporting members with a circular shape form only two concentric circular structures, a first nature frequency thereof is 450 Hz.

Figure 6B:
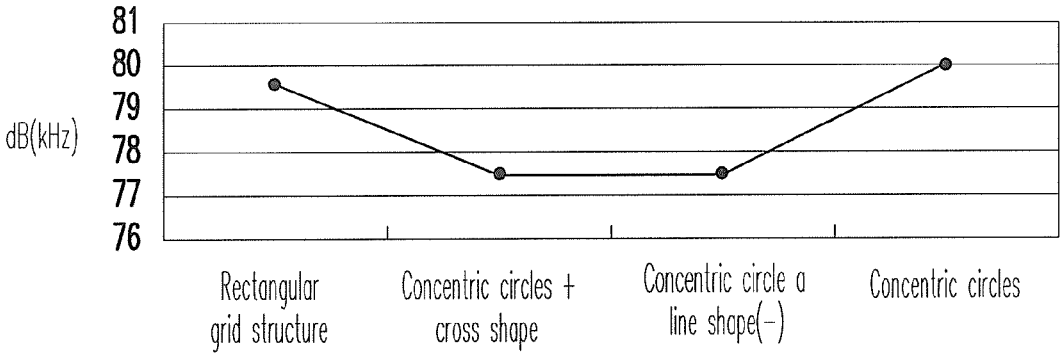
FIG. 6B is a line chart showing sound pressures at a frequency of 1000 Hz generated by speaker structures having supporting members which are arranged differently.

Furthermore, please refer to FIG. 6B, which is a line chart showing sound pressures at a frequency of 1000 Hz generated by speaker structures having supporting members arranged with different patterns. When supporting members with a square shape form a rectangular grid figure structure, a sound pressure generated therefrom at the frequency of 1000 Hz is 79.5 dB; when supporting members with a circular shape form two concentric circular structures and a cross-shaped structure, a sound pressure generated therefrom at the frequency of 1000 Hz is 77.5 dB; when supporting members with a circular shape form two concentric circular structures and a line-shaped structure, a sound pressure generated therefrom at the frequency of 1000 Hz is 77.5 dB; when supporting members with a circular shape faun only two concentric circular structures, a sound pressure generated therefrom at the frequency of 1000 Hz is 80.5 dB.

In summary, the embodiments the metal electrode and the membrane are prevented from contacting to each other due to the electrostatic forces and simultaneously increase sound pressures when the electrostatic speakers operate at low frequencies. The geometric structure for the supporting members of a flat electrostatic speaker can be fabricated by being integrated the existing processes of making flat electrostatic speakers and therefore may be suitable for mass production. The choice of the embodiments cooperating with flexible materials provides a breakthrough in flat speaker structures, thereby completing acoustic components required for the characteristics of flexible electronics.

It will be apparent to those skilled in the art that various modifications and variations can be made to the structure of the embodiment without departing from the scope or spirit of the embodiment. In view of the foregoing, it is intended that the embodiment cover modifications and variations of this embodiment provided they fall within the scope of the following claims and their equivalents.

What is claimed is:

1. A speaker structure, comprising:

a membrane, comprising at least one electret layer and a conductive electrode layer;

an electrode, having a plurality of holes;

a frame holding member used to hold the membrane and the electrode at two opposite sides; and at least a set of supporting members, wherein each of the set of the supporting members has a ring-shaped geometric structure and is placed in a space opposite to a coniferous hole region between the electrode and the membrane, and the arrangement of the ring-shaped geometric structures is based on intensities of electrostatic effects of the membrane.

2. The speaker structure of claim 1, wherein the ring-shaped geometric structure of the supporting members further comprises a line-shaped structure or a cross-shaped structure.

3. The speaker structure of claim 1, wherein the ring-shaped geometric structure is formed by a plurality of circles, hexagons, ovals, squares, rhombuses, rectangles, triangles, polygon structures, or combinations thereof.

4. The speaker structure of claim 1, wherein distances between each two of the supporting members with the ring-shaped geometric structures are equal or unequal.

5. The speaker structure of claim 1, wherein the supporting member with the ring-shaped geometric structure is a closed figure structure or an open figure structure.

6. The speaker structure of claim 5, wherein the closed figure structure is formed by a continuous line.

7. The speaker structure of claim 5, wherein the open figure structure is formed by a plurality of broken lines.

8. The speaker structure of claim 1, wherein a heights of the supporting members are uniform or non-uniform.

9. The speaker structure of claim 1, wherein the supporting members with the ring-shaped geometric structures are substantially concentric.

10. The speaker structure of claim 1, wherein the supporting members are formed on the electrode or on the membrane by using a transferring process.

11. The speaker structure of claim 10, wherein the transferring process comprises an ink-jet printing or a screen plane printing.

12. The speaker structure of claim 1, wherein the supporting members are formed on the electrode or on the membrane using a transfer printing.

13. The speaker structure of claim 12, wherein a decaling process comprises the supporting members optionally adhering to the membrane or the electrode.

14. The speaker structure of claim 1, wherein the supporting members are formed on the electrode or on the membrane using an etching process.

15. The speaker structure of claim 1, wherein the supporting members are formed on the electrode or on the membrane by using a photolithography process.

16. The speaker structure of claim 1, wherein a material of the membrane, the electrode, the frame holding member and the supporting members are made from a transparent and flexible materials.

17. The speaker structure of claim 1, wherein the electrode is made from aluminum, gold, silver, copper, Ni/Au bimetal, indium tin oxide (ITO), indium zinc oxide (IZO), macromolecule conductive material PEDOT (polyethylenedioxythiophene), an alloy, or any combination thereof.

18. The speaker structure of claim 1, wherein a material of the electret layer is selected from one of the group consisting of fluorinated ethylene propylene, poly tera fluoro ethyene, polyvinylidene fluoride, fluorine polymers and any combination thereof.

19. The speaker structure of claim 1, wherein the conductive electrode layer of the membrane comprises a nonconductive material layer plated with a metal film layer.

20. The speaker structure of claim 19, wherein the nonconductive material layer is made of plastic, rubber, paper, or nonconductive cloth materials.

21. The speaker structure of claim 19, wherein the plated metal film layer is made from aluminum, gold, silver, copper, Ni/Au bimetal, indium tin oxide (ITO), indium zinc oxide (IZO), macromolecule conductive material PEDOT (polyethylenedioxythiophene), an alloy, or any combination thereof.

22. The speaker structure of claim 1, wherein the conductive electrode layer of the membrane is made from aluminum, gold, silver, copper, Ni/Au bimetal, indium tin oxide (ITO), indium zinc oxide (IZO), macromolecule conductive material PEDOT (polyethylenedioxythiophene), an alloy, or any combination thereof.

23. The speaker structure of claim 1, wherein the ring-shaped geometric structures are disposed non-concentrically.

* * * * *